US010573973B2

(12) United States Patent
Bosshard et al.

(10) Patent No.: US 10,573,973 B2
(45) Date of Patent: Feb. 25, 2020

(54) CAVITY-BACKED RADIATING ELEMENT AND RADIATING ARRAY INCLUDING AT LEAST TWO RADIATING ELEMENTS

(71) Applicant: THALES, Courbevoie (FR)

(72) Inventors: Pierre Bosshard, Tournefeuille (FR); Jean-Baptiste Schrottenloher, Toulouse (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/722,962

(22) Filed: Oct. 2, 2017

(65) Prior Publication Data

US 2018/0097292 A1 Apr. 5, 2018

(30) Foreign Application Priority Data

Oct. 4, 2016 (FR) ..... 16 01432

(51) Int. Cl.
*H01Q 21/06* (2006.01)
*H01Q 19/17* (2006.01)
*H01Q 9/04* (2006.01)

(52) U.S. Cl.
CPC ..... *H01Q 21/06* (2013.01); *H01Q 9/0414* (2013.01); *H01Q 19/17* (2013.01); *H01Q 21/061* (2013.01); *H01Q 21/065* (2013.01)

(58) Field of Classification Search
CPC .... H01Q 21/06; H01Q 21/065; H01Q 9/0414; H01Q 19/17; H01Q 21/061
See application file for complete search history.

(56) References Cited

U.S. PATENT DOCUMENTS 5,010,348 A 4/1991 Rene et al.
2004/0090370 A1* 5/2004 McCarrick ..... H01Q 9/0414 343/700 MS
2012/0062440 A1 3/2012 Tasaki et al.
2012/0112977 A1 5/2012 Yun

FOREIGN PATENT DOCUMENTS

WO 2017/100126 A1 6/2017

OTHER PUBLICATIONS

S. Rawat et al., "Stacked elliptical patches for circularly polarized broadband performance," IEEE2014 International Conference on Signal Propagation and Computer Technology, Jul. 12, 2014, pp. 232-235, XP032631327.

(Continued)

*Primary Examiner* — Hai V Tran
*Assistant Examiner* — Michael M Bouizza
(74) *Attorney, Agent, or Firm* — Baker & Hostetler LLP

(57) ABSTRACT

A radiating element comprises a cavity that is axially symmetric about an axis Z, a metal central core that extends axially at the center of the cavity and N different successive metal elliptical planar elements that are stacked on top of one another parallelly to the lower wall of the cavity, the central core comprises a lower end that is fastened to the lower metal wall of the cavity and an upper end that is free, each elliptical metal planar element being centered in the cavity and secured to the central core, the N elliptical planar elements being regularly spaced and having dimensions that decrease monotonically between the lower end and the upper end of the central core, where N is an integer higher than 2.

10 Claims, 5 Drawing Sheets

(56) References Cited

OTHER PUBLICATIONS

A. Weily et al., "Circularly Polarized Ellipse-Loaded Circular Slot Array for Millimeter-Wave WPAN Applications," IEEE Transactions on Antennas and Propagation, vol. 57, No. 10, Oct. 1, 2009, pp. 2862-2870, XP011271562.

M. Koutsoupidou et al., "A microwave breast imaging system using elliptical uniplanar antennas in a circular-array setup," 2015 IEEE International Conference on Imaging Systems and Techniques, Sep. 16, 2015, pp. 1-4, XP032791411.

X. Zhang et al., "Design of circularly polarized stacked microstrip antennas," IEEE 8th International Symposium on Antennas, Propagation and EM Theory, Nov. 2, 2008, pp. 11-14, XP031398978.

* cited by examiner

CAVITY-BACKED RADIATING ELEMENT AND RADIATING ARRAY INCLUDING AT LEAST TWO RADIATING ELEMENTS

CROSS-REFERENCE TO RELATED APPLICATION

This application claims priority to foreign French patent application No. FR 1601432, filed on Oct. 4, 2016, the disclosure of which is incorporated by reference in its entirety.

FIELD OF THE INVENTION

The present invention relates to a new cavity-backed radiating-element architecture and to a radiating array including at least two radiating elements. It in particular applies to the field of space systems & solutions and mono-beam or multibeam applications.

BACKGROUND

A radiofrequency source used in an antenna consists of a radiating element coupled to an RF radiofrequency chain. In low-frequency bands, for example in the C band, the radiating element often consists of a horn and the RF chain includes RF components intended to perform dual-polarization or single-polarization reception and emission functions in order to meet the needs of users. Links with ground stations are generally dual-polarization.

The mass and bulk of RF radiofrequency chains is a critical point in the field of space antennae intended to be installed onboard satellites, in particular in the domain of the lowest frequencies such as in the C band. In the high-frequency domain, for example the Ka band or Ku band, there exist very compact radiating elements the technology of which may be transposed to the C band, but the radiofrequency sources obtained remain bulky and of substantial mass and installation problems arise when they must be integrated into a focal array including many sources.

Cavity-backed radiating elements that have the advantage of being compact exist, but these radiating elements are limited in terms of passband and can be used only in single-polarization and in a single operating frequency band or in two very narrow frequency bands.

SUMMARY OF THE INVENTION

The aim of the invention is to remedy the drawbacks of known radiating elements and to produce a new radiating element that is compact and that has a passband that is large enough to allow operation in two separate frequency bands, respectively for emission and reception in low-frequency bands including the C band, and also allowing operation in two orthogonal circular polarizations, namely left and right circular polarizations, respectively.

In this respect, the invention relates to a radiating element including a cavity that is axially symmetric about an axis Z and a power source, the cavity being bounded by lateral metal walls and a lower metal wall. The radiating element furthermore includes a metal central core that extends axially at the center of the cavity and N different successive metal elliptical planar elements that are stacked on top of one another parallelly to the lower wall of the cavity, the central core including a lower end that is fastened to the lower metal wall of the cavity and an upper end that is free, each elliptical planar element being centered in the cavity and secured to the central core, the N elliptical planar elements being regularly spaced and having dimensions that decrease monotonically between the lower end and the upper end of the central core, where N is an integer higher than 2.

Advantageously, the N elliptical planar elements have dimensions that decrease exponentially.

According to one variant, the N elliptical planar elements have dimensions that decrease according to a polynomial function.

Advantageously, the power source may consist of a coaxial line connected to the first elliptical planar element located closest to the lower end of the central core and the N successive elliptical planar elements may be progressively offset rotationally with respect to one another, about the central core.

Alternatively, the power source may consist of two coaxial lines connected, at two different connection points, to the first elliptical planar element located closest to the lower end of the central core, the two connection points being respectively placed on two directions of the first elliptical planar element, which directions are perpendicular to each other, the N elliptical planar elements all being aligned in one common direction.

The invention also relates to a radiating array including at least two radiating elements.

Advantageously, the radiating elements of the radiating array may be arranged beside one another on a common carrier plate.

Advantageously, those radiating elements of the radiating array which are adjacent may be spatially arranged so that their respective elliptical planar elements are respectively oriented in two directions that are orthogonal to each other.

Advantageously, the radiating array may furthermore include absorbent dielectric elements placed between two adjacent radiating elements.

BRIEF DESCRIPTION OF THE DRAWINGS

Other particularities and advantages of the invention will become more clearly apparent from the rest of this description, which is given merely by way of purely illustrative and nonlimiting example with reference to the appended schematic drawings, which show.

DETAILED DESCRIPTION

Figure 1A:
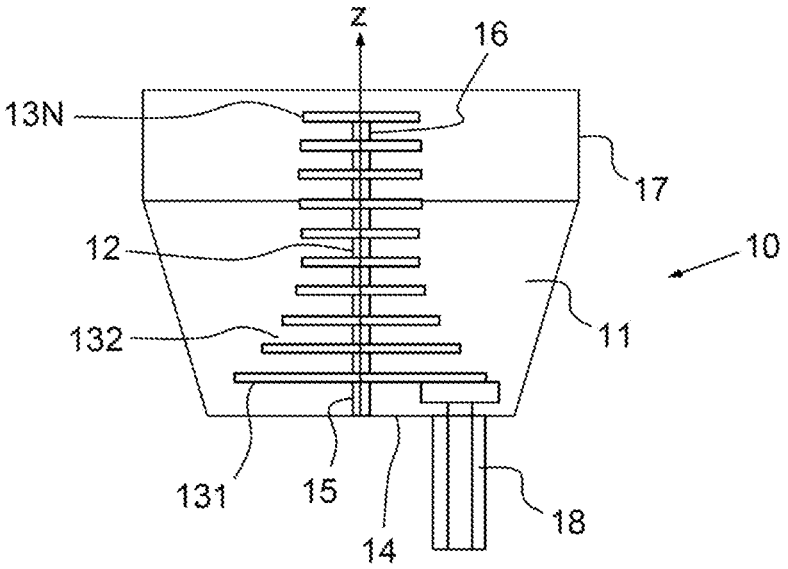
FIGS. 1*a*, 1*b* and 1 *c*: three schematics, respectively an axial cross section, a perspective view and a view from above, of an example of a dual-polarization radiating element according to the invention.
Figure 1B:
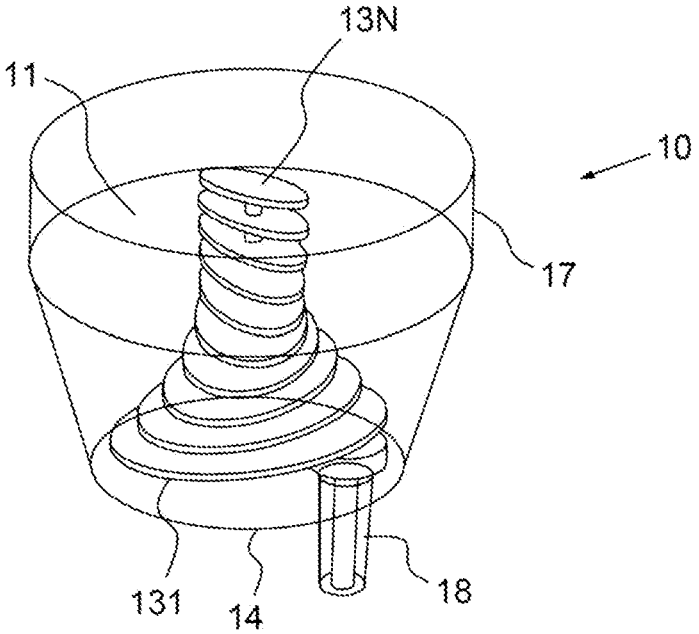
Figure 1C:
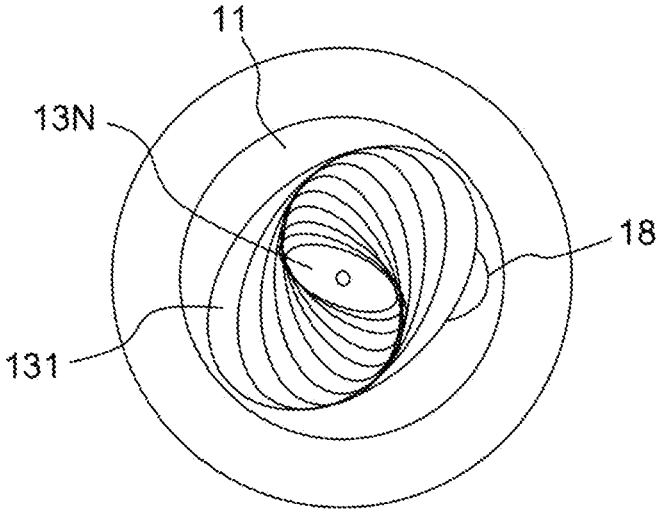
FIG. 1*d*: a schematic of an axial cross section of a variant embodiment of the radiating element, according to the invention.

The radiating element 10 shown in FIGS. 1*a*, 1*b* and 1*c* includes a cavity 11 that is axially symmetric about an axis Z, a metal central core 12 that extends axially at the center of the cavity 11 and N different metal planar elements 131, 132, . . . , 13N that are stacked on top of one another parallelly to one another and parallelly to a lower metal wall 14 of the cavity 11, also called the bottom of the cavity, N being an integer higher than 2, the N metal planar elements being centered in the cavity and secured to the central core 12. The central core 12 includes a lower end 15 that is fastened to the lower metal wall 14 of the cavity and an upper end 16 that is free. Each metal planar element 131, 132, . . . , 13N is what is called an elliptical planar element and has an elliptical outline the orientation and the dimensions of which are defined by the orientation and the dimensions of the major axis and of the minor axis of the corresponding ellipse. For each of the elliptical planar elements 131, 132, . . . , 13N the dimensions of the major axis and of the minor axis of a given elliptical outline are different, the ratio between the length of the minor axis and the length of the major axis preferably being smaller than 0.99, and advantageously smaller than 0.9. The N elliptical planar elements 131, 132, . . . , 13N are regularly spaced along the central core 12 and have dimensions that decrease monotonically between the lower end 15 and the upper end 16 of the central core. Preferably, the monotony of the decrease is strict. As a variant, the dimensions of certain elliptical planar elements may be equal, the elliptical planar elements then not necessarily all having the same dimensions. According to one embodiment, the dimensions of the N elliptical planar elements decrease exponentially, namely they decrease according to the exponential function. As a variant, the dimensions of the N elliptical planar elements decrease according to a polynomial function. By decrease according to a polynomial function, what is meant is that the dimensions of the N elliptical planar elements may be determined by a monotonic portion of a function f of type:

$$f(x)=a_n x^n+a_{n-1}x^{n-1}+\ldots+a_1x^1+a_0x^0$$

where n is a natural integer and $a_n$, $a_{n-1}$, $a_1$, $a_0$ are real coefficients of the polynomial function f.

The cavity 11 is bounded by the lower metal wall 14 and by lateral metal walls 17 and is filled with air. The radiating element 10 furthermore includes at least one power source for example consisting of a coaxial line 18 connected to the first elliptical planar element 131 located closest to the lower end 15 of the central core 12. Thus, only the first elliptical planar element 131 is supplied with power directly by the coaxial line 18. The first elliptical planar element 131 radiates a radiofrequency wave that propagates in the cavity and generates currents on the surface of the other elliptical planar elements 132, . . . , 13N, which are then coupled in turn by induced electromagnetic coupling. The first elliptical planar element 131 is therefore an exciter planar element.

Figure 1D:
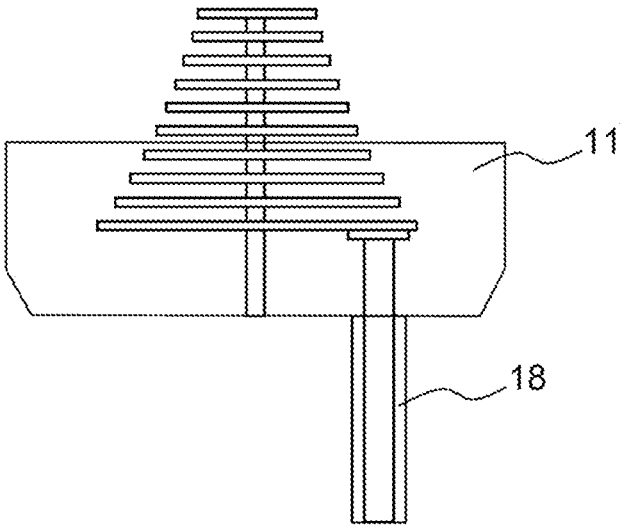

The major axes of the elliptical shapes corresponding to the various elliptical planar elements may all be oriented in a single common direction or in different directions. The N elliptical planar elements may all be housed in the interior of the cavity, as illustrated in FIGS. 1*a*, 1*b* and 1 *c*, but this is not obligatory and alternatively a few elliptical planar elements corresponding to the smallest dimensions and to the highest frequencies may protrude from the cavity as shown in FIG. 1*d*.

When the radiating element includes a single coaxial supply line 18, the various elliptical planar elements 131, 132, . . . , 13N may be progressively offset rotationally with respect to one another about the central core 15, as for example shown in FIG. 1*b*. The major axes of the elliptical shapes corresponding to the various elliptical planar elements are then oriented in different directions. The rotational offset of the various elliptical planar elements allows the radiating element to emit circularly polarized radiation. The radiating axis of the radiating element corresponds to the axis Z.

Figure 2:
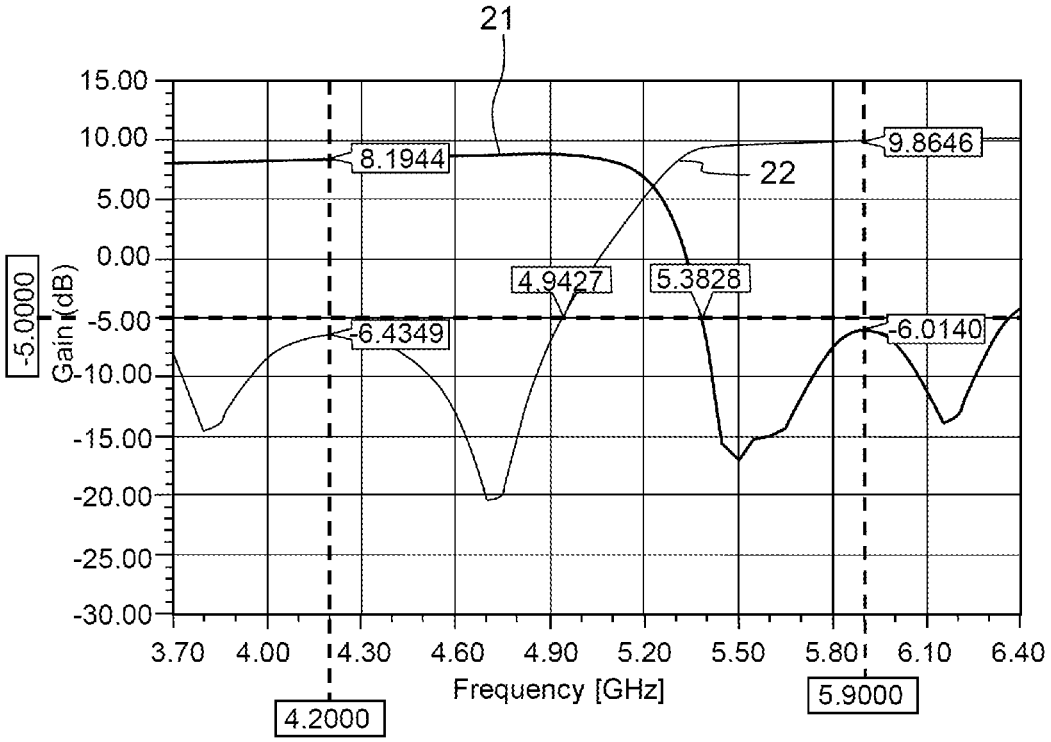
FIG. 2: a graph illustrating two curves of the gain of the radiating element of FIG. 1, as a function of frequency, respectively corresponding to a first circular polarization and to a second circular polarization, according to invention.

The graph of FIG. 2 shows two curvey 21, 22 of the gain of a radiating element according to the invention, as a function of frequency, the radiating element being supplied via a single coaxial line and including elliptical planar elements that are progressively offset rotationally with respect to one another as in FIGS. 1*a*, 1*b*, 1*c* and 1 *d*. The rotational offset between the first and Nth elliptical planar elements is about 90°.

The first curve 21 corresponds to the gain of the radiating element in a clockwise first circular polarization and the second curve 22 corresponds to the gain of the radiating element in a counterclockwise second circular polarization.

As these two curves show, with a single supply line, the radiating element functions in two different very-wide passbands comprised between 3.7 GHz and 6.4 GHz and in each passband the polarizations are different and inverted. In each passband, the cross-polarization is lower than −15 dB with respect to the corresponding operating polarization.

This radiating element therefore allows operation in two separate different frequency bands, for example for emission and reception, with different polarizations and a good level of gain.

These two curves 21, 22 show that the association of the cavity with a plurality of elliptical planar elements of different dimensions allows the radiating element to radiate over a passband that is much wider than in conventional radiating elements. This is due to the fact that the elliptical planar elements with the largest dimensions participate in the radiation by the radiating element of low frequencies whereas the elliptical planar elements of smaller dimensions participate in the radiation by the radiating element of high frequencies. The progressiveness of the decrease in the dimensions of the elliptical planar elements along the central core 12 allows radiation to be radiated continuously over a wide frequency band. Furthermore, the dual-circular-polarization operation is due to a particularly noteworthy natural effect corresponding to a natural inversion of the direction of the polarization in the highest frequency bands.

This natural inversion of the direction of the polarization, in the band corresponding to the highest operating frequencies, for example the reception band, is a novel effect that has never been observed in conventional radiating elements and is due to coupling between the exciter elliptical planar element 131 and the bottom of the cavity 14 formed by the lower wall of the cavity. Reflection, from the bottom of the cavity 14, of the radiofrequency waves emitted by the exciter elliptical planar element 131 and corresponding to the highest operating frequencies, has the effect of inverting the direction of the polarization.

The electrical field corresponding to the highest frequencies is reflected by the lower wall 14 of the cavity and is reemitted toward the top of the cavity after inversion of the direction of the polarization. In contrast, the electric field corresponding to the low frequencies is emitted directly toward the top of the cavity without reflection and without inversion of the direction of the polarization.

Figure 3A:
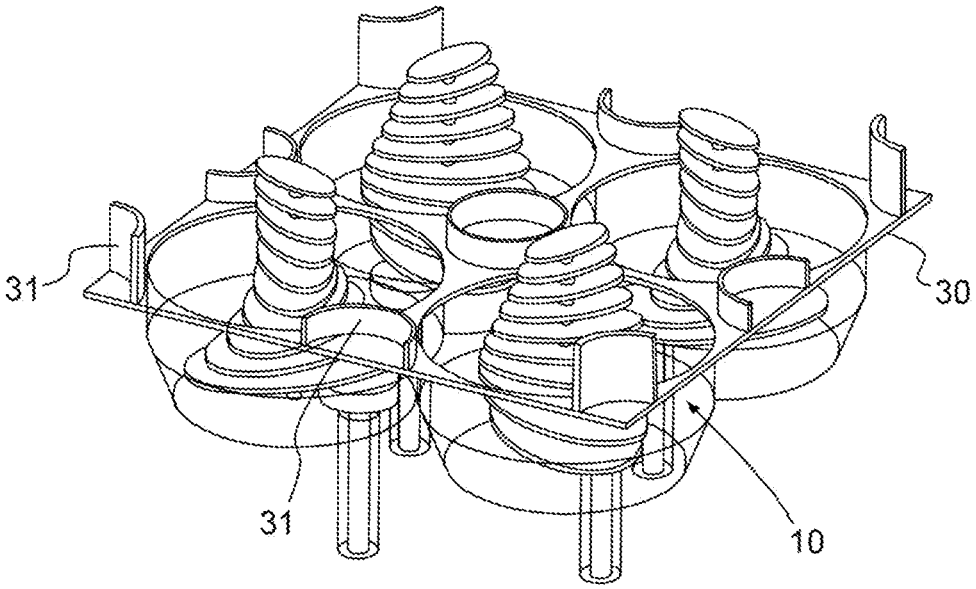
FIGS. 3*a* and 3*b*: two schematics, respectively a perspective view and a view from above, of a first example of a radiating array including four radiating elements, according to invention.
Figure 3B:
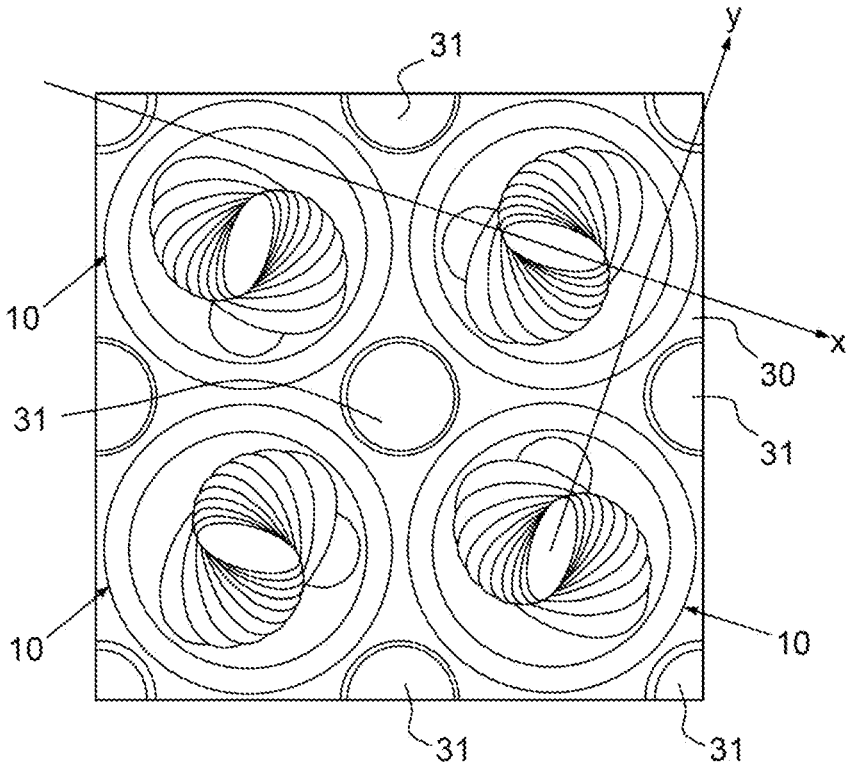

It is possible to assemble a plurality of identical radiating elements 10 to form a two-dimensional planar radiating array of large size as illustrated for example in FIGS. 3*a* and 3*b*, in which four radiating elements of the array have been shown. In the radiating array, the various radiating elements are arranged beside one another and their respective cavities are joined together by a common metal carrier plate 30 forming a metal ground plane. Of course, the radiating array is not limited to four radiating elements but may include any number of radiating elements higher than two. However, since the radiating elements have a small aperture at a central half wavelength of operation, at the bottom of the emission frequency band, the radiating elements couple together with high field levels that have the effect of degrading polarization purity. To solve this problem, according to the invention, absorbent elements 31 made from a dielectric material have been added between adjacent radiating elements and fastened to the metal carrier plate 30. The absorbent elements are volumes of dielectric that may be of any shape, and they may be positioned at junction points between four adjacent radiating elements, as shown in FIGS. 3*a* and 3*b*. The height of the absorbent elements may vary depending on their position in the array and depending on the frequency of the parasitic coupling to be eliminated. The dielectric material may for example be a material such as silicon carbide SiC.

Furthermore, as formation of an array may lead to an increase in cross-polarization, adjacent radiating elements are spatially arranged so that their respective elliptical planar elements are respectively oriented parallelly to two directions, X and Y, that are orthogonal to each other, i.e. the directions of the major axes of their respective elliptical planar elements are orthogonal to each other, as illustrated in FIG. 3*b*. By virtue of the superposition of a plurality of field ellipses that are orthogonal to one another, this sequential spatial arrangement of the successive radiating elements allows the purity of the two circular polarizations generated by the various radiating elements of the array to be improved and cross-polarization along the radiating axis of the array to be clearly decreased.

According to a second embodiment of the invention, the various elliptical planar elements of each radiating element are not rotationally offset with respect to one another, the major axes of their respective elliptical shapes instead all being aligned in one common direction.

Figure 4A:
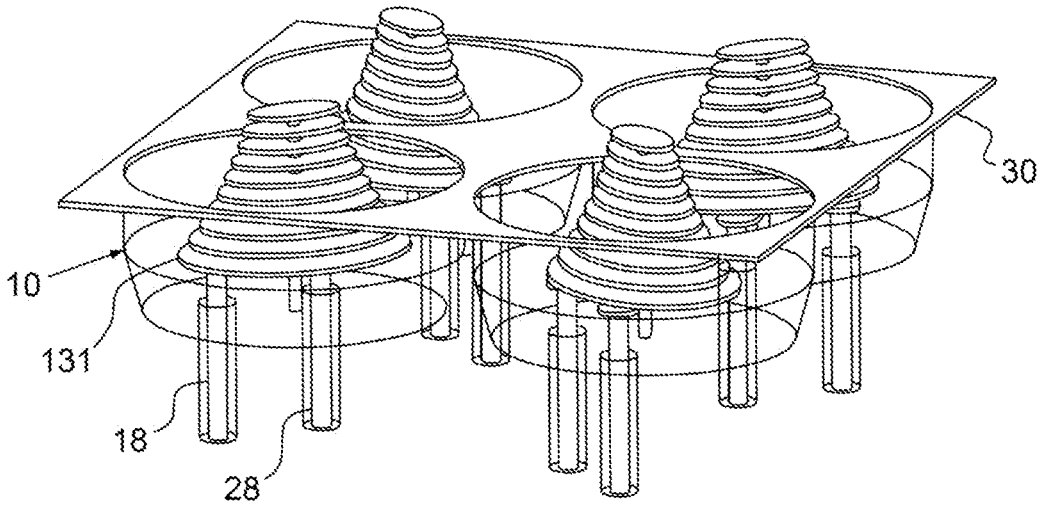
FIGS. 4*a* and 4*b*: two schematics, respectively a perspective view and a view from above, of a second example of a radiating array including four radiating elements, according to the invention.
Figure 4B:
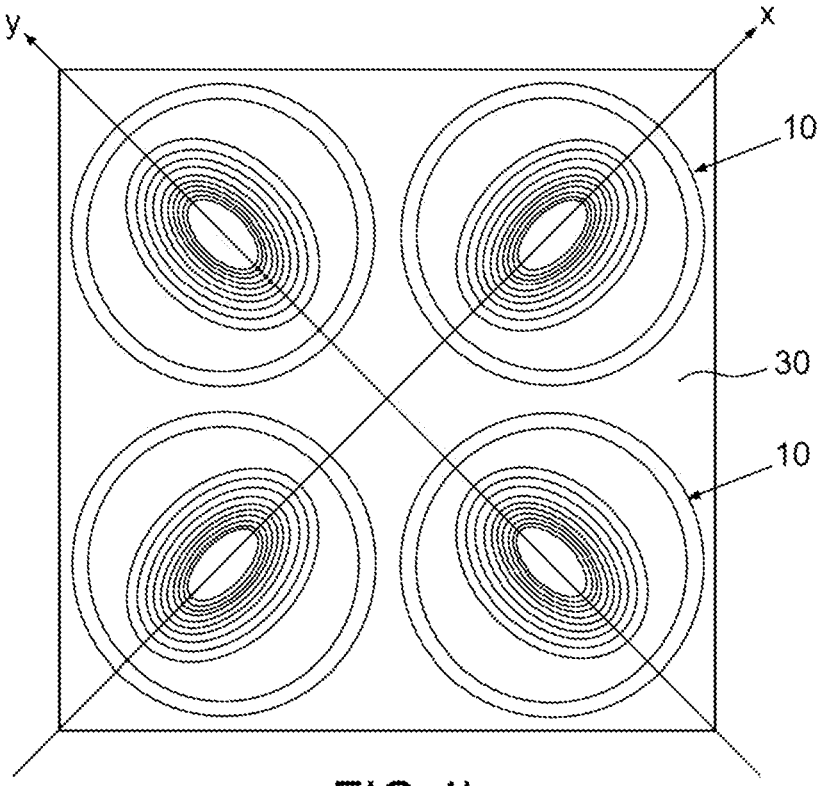

In this case, to make the radiating element operate in two polarizations that are orthogonal to each other, each radiating element 10 includes two coaxial supply lines 18, 28 that are connected to the first elliptical planar element 131 located closest to the lower end of the central core. The two coaxial supply lines 18, 28 are respectively connected to two different connection points of the first elliptical planar element 131, the two connection points being placed on two different directions of the first elliptical planar element 131, which directions are perpendicular to each other and possibly correspond, for example, to the directions of the major axis and of the minor axis of the elliptical shape of the first elliptical planar element 131. Thus, only the first elliptical planar element is directly supplied with power by the two coaxial lines in two orthogonal polarizations. In this case, the radiating element 10 can operate only in a single frequency band and in dual-polarization because it is, in this case, not possible to select both a frequency band and a single polarization. In this second embodiment, to emit and receive it is then necessary to produce radiating elements of different dimensions adapted either to an operating frequency band dedicated to emission or to an operating frequency band dedicated to reception, respectively. FIGS. 4*a* and 4*b* illustrate an example of an array including radiating elements according to this second embodiment of the invention. As FIG. 4*b* shows, adjacent radiating elements are spatially arranged so that their respective elliptical planar elements are respectively oriented in two directions, X and Y, that are orthogonal to each other, i.e. the directions of the major axes of their respective elliptical planar elements are orthogonal to each other.

Although the invention has been described with reference to particular embodiments, obviously it is in no way limited thereto and comprises any technical equivalent of the means described and combinations thereof if they fall within the scope of the invention. In particular, the arrays of radiating elements are not limited to four radiating elements but may include a number of radiating elements higher than two.

The invention claimed is:

1. A radiating element including:

a cavity that is axially symmetric about an axis Z and a power source, the cavity being bounded by lateral metal walls and a lower metal wall, a metal central core that extends axially at the center of the cavity and N different successive metal elliptical planar elements that are stacked on top of one another parallelly to the lower wall of the cavity, the central core including:

a lower end that is fastened to the lower metal wall of the cavity and an upper end that is free, wherein each elliptical planar element is centered in the cavity and secured to the central core, the N elliptical planar elements being regularly spaced and having dimensions that decrease monotonically between the lower end and the upper end of the central core, where N is an integer greater than 2, and wherein the N successive elliptical planar elements are progressively offset rotationally with respect to one another, about the central core.

2. The radiating element as claimed in claim 1, wherein the N elliptical planar elements have dimensions that decrease exponentially.

3. The radiating element as claimed in claim 1, wherein the N elliptical planar elements have dimensions that decrease according to a polynomial function.

4. The radiating element as claimed in claim 1, wherein the power source comprises a coaxial line connected to the first elliptical planar element located closest to the lower end of the central core.

5. A radiating array comprising at least two radiating elements as claimed in claim 1.

6. The radiating array as claimed in claim 5, wherein the radiating elements are arranged beside one another on a common carrier plate.

7. The radiating array as claimed in claim 6, wherein radiating elements that are adjacent to one another are spatially arranged so that their respective elliptical planar elements are respectively oriented in two directions that are orthogonal to each other.

8. The radiating array as claimed in claim 7, further comprising absorbent dielectric elements placed between two adjacent radiating elements.

9. A radiating array, comprising:

at least two radiating elements, each radiating element comprising:

a cavity that is axially symmetric about an axis Z, the cavity being bounded by lateral metal walls and a lower metal wall, and a power source;

a metal central core that extends axially at the center of the cavity; and

N different successive metal elliptical planar elements that are stacked on top of one another parallelly to the lower wall of the cavity, wherein the central core includes a lower end that is fastened to the lower metal wall of the cavity and an upper end that is free, wherein each elliptical planar element is centered in the cavity and secured to the central core, wherein the N elliptical planar elements are regularly spaced and have dimensions that decrease monotonically between the lower end and the upper end of the central core, N being an integer greater than 2, wherein the radiating elements are arranged beside one another on a common carrier plate, and wherein radiating elements that are adjacent to one another are spatially arranged so that their respective elliptical planar elements are respectively oriented in two directions that are orthogonal to each other.

10. The radiating array as claimed in claim 9, wherein, for each radiating element, the power source comprises two coaxial lines connected, at two different connection points, to the first elliptical planar element located closest to the lower end of the central core, the two connection points being respectively placed on two directions of the first elliptical planar element, which directions are perpendicular to each other, and wherein the N elliptical planar elements are all aligned in one common direction.

* * * * *